US009236031B2

(12) United States Patent
Cho et al.

(10) Patent No.: US 9,236,031 B2
(45) Date of Patent: Jan. 12, 2016

(54) METHOD FOR SYNCHRONIZING A DISPLAY HORIZONTAL SYNCHRONIZATION SIGNAL WITH AN EXTERNAL HORIZONTAL SYNCHRONIZATION SIGNAL

(75) Inventors: Chih-Wen Cho, Hsin-Chu (TW); Yung-Chih Wu, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 563 days.

(21) Appl. No.: 13/354,351

(22) Filed: Jan. 20, 2012

(65) Prior Publication Data

US 2012/0262627 A1 Oct. 18, 2012

(30) Foreign Application Priority Data

Apr. 18, 2011 (TW) ..... 100113350 A

(51) Int. Cl.
*G09G 5/12* (2006.01)
*G09G 5/00* (2006.01)

(52) U.S. Cl.
CPC ..... *G09G 5/12* (2013.01); *G09G 5/006* (2013.01); *G09G 2330/021* (2013.01); *G09G 2360/18* (2013.01); *G09G 2370/10* (2013.01)

(58) Field of Classification Search
CPC ... G09G 5/12; G09G 5/006; G09G 2330/021; G09G 2370/10; G09G 2360/18
See application file for complete search history.

(56) References Cited

U.S. PATENT DOCUMENTS

| | | | | |
|---|---|---|---|---|
| 7,009,604 | B2 | 3/2006 | Chan | |
| 7,868,848 | B2 | 1/2011 | Dai | |
| 2003/0062925 | A1* | 4/2003 | Nedovic et al. | 326/93 |
| 2006/0261282 | A1* | 11/2006 | Nakajima | 250/370.14 |
| 2008/0036748 | A1 | 2/2008 | Lees | |
| 2008/0180432 | A1 | 7/2008 | Lee | |
| 2009/0079746 | A1* | 3/2009 | Howard et al. | 345/502 |
| 2010/0245316 | A1* | 9/2010 | Cheng | 345/211 |
| 2011/0161574 | A1* | 6/2011 | Minami | 711/104 |

FOREIGN PATENT DOCUMENTS

| | | | |
|---|---|---|---|
| CN | 1645314 | A | 7/2005 |
| CN | 101051432 | A | 10/2007 |
| CN | 101491090 | A | 7/2009 |
| TW | 200832350 | | 8/2008 |
| TW | I331316 | | 10/2010 |

* cited by examiner

*Primary Examiner* — Aneeta Yodichkas
(74) *Attorney, Agent, or Firm* — Winston Hsu; Scott Margo

(57) ABSTRACT

Adjust a vertical blanking interval of a display horizontal synchronization signal, according to a difference between an external horizontal synchronization signal and the display horizontal synchronization signal, for synchronizing the display horizontal synchronization signal to the external horizontal synchronization signal. This only requires one or two frames to synchronize the display horizontal synchronization signal to the external horizontal synchronization signal, and will not cause the user to perceive display pauses or flickers.

18 Claims, 7 Drawing Sheets

METHOD FOR SYNCHRONIZING A DISPLAY HORIZONTAL SYNCHRONIZATION SIGNAL WITH AN EXTERNAL HORIZONTAL SYNCHRONIZATION SIGNAL

BACKGROUND

1. Technical Field

The present invention is related to a method for synchronizing signals, and more particularly, to a method for synchronizing a display horizontal synchronization signal to an external horizontal synchronization signal and devices thereof.

2. Description of the Prior Art

DisplayPort, a standard announced by the Video Electronics Standards Association (VESA), simplifies display design and connections. DisplayPort possesses stable electrical characteristics, hence providing higher resolution support.

A number of companion standards have developed according to DisplayPort, for providing optimization to different applications. For instance, internal DisplayPort (iDP) targets digital TV systems and high-end display devices, Embedded DisplayPort (eDP) standard targets embedded display devices (e.g. laptop displays, etc.), and Mini DisplayPort (mDP) standard is for miniaturized connectors. Taking the Embedded DisplayPort standard as an example, a laptop can output signals from a processing unit (e.g. a graphics processing unit) to control the display panel directly, for reducing components and wiring required between the monitor and the motherboard. This way, weight and power consumption of the laptop can be reduced, and product appearance can be more streamlined.

Please refer to FIG. 1. FIG. 1 is a diagram illustrating a conventional portable device 100 comprising a DisplayPort interface. The portable device 100 comprises a processing unit 110 and a display device 120. The processing unit 110 comprises a transmitting end Tx, and can be a central processing unit (CPU) or a graphics processing unit (GPU), etc. The display device 120 comprises a receiving end Rx, buffer memory M and a timing controller TCON. The transmitting end Tx and the receiving end Rx are both compliant to DisplayPort interface. The transmitting end Tx of the processing unit 110 is coupled to the receiving end Rx of the display device 120 via a unilateral Main Link (ML) and a bilateral Auxiliary Link (AL). The buffer memory M stores, for instance, data of a static image.

The DisplayPort interface comprises Panel Self-Refresh (PSR) technology. When a user operates the portable device 100, the processing unit 110 transmits a driving signal to the display device 120. The timing controller TCON drives the display device 120 according to the driving signal transmitted by the processing unit 110. When the portable device 100 is idle for a predetermined duration, the processing unit 110 stops transmitting the driving signal to the display device 120. The timing controller TCON then self-generates the driving signal to drive the display device 120 for displaying the static image stored in the buffer memory M. This way, the Panel Self-Refresh technology can further reduce the power consumption of the portable device 100 when the portable device 100 is idle.

When the portable device 100 is operated again in the idle state, the processing unit 110 begins transmitting the driving signal to the display device 120 again. However, time sequence and phase of the driving signal generated by the processing unit 110 may be different from those of the driving signal generated by the timing controller TCON. The timing controller TCON is required to be synchronized with the processing unit 110 for the timing controller TCON to drive the display device 120 according to the driving signal transmitted by the processing unit 110 again. Generally, the timing controller TCON utilizes a continuous capture method to adjust internal signal timing of the display device 120, which changes a frame rate of the display device 120, so as to synchronize the driving signals generated by the processing unit 110 and the timing controller TCON. To reduce frame loss during synchronization, read/write action of a frame buffer is controlled to synchronize the driving signal generated by the timing controller TCON to the driving signal generated by the processing unit 110. However, synchronizing the internal driving signal generated by the timing controller TCON to the external driving signal generated by the processing unit 110 requires complicated read/write action of the frame buffer, and utilizes extra hardware resources such as a line buffer, etc. Furthermore, substantial frame duration is required to achieve synchronization between the driving signals generated by the timing controller TCON and the processing unit 110, such that the user perceives pauses in screen display of the display device 120, causing viewing discomfort.

SUMMARY

An embodiment of the present invention discloses a method for synchronizing a display horizontal synchronization signal to an external horizontal synchronization signal. The method comprises receiving the external horizontal synchronization signal; calculating a difference between the external horizontal synchronization signal and the display horizontal synchronization signal; and adjusting a vertical blanking interval of the display horizontal synchronization signal according to the difference between the external horizontal synchronization signal and the display horizontal synchronization signal, for synchronizing the display horizontal synchronization signal to the external horizontal synchronization signal.

Another embodiment of the present invention further discloses a display device. The display device comprises a receiving unit, a calculating unit and a synchronizing unit. The receiving unit is for receiving an external horizontal synchronization signal. The calculating unit is for calculating a difference between the external horizontal synchronization signal and a display horizontal synchronization signal. The synchronizing unit is for adjusting a vertical blanking interval of the display horizontal synchronization signal according to the difference between the external horizontal synchronization signal and the display horizontal synchronization signal, for synchronizing the display horizontal synchronization signal to the external horizontal synchronization signal.

Another embodiment of the present invention further discloses a method for synchronizing a display horizontal synchronization signal to an external horizontal synchronization signal. The method comprises receiving the external horizontal synchronization signal, wherein a phase difference exists between the external horizontal synchronization signal and the display horizontal synchronization signal; and adjusting a vertical blanking interval of the display horizontal synchronization signal according to a difference between the external horizontal synchronization signal and the display horizontal synchronization signal, for synchronizing the display horizontal synchronization signal to the external horizontal synchronization signal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
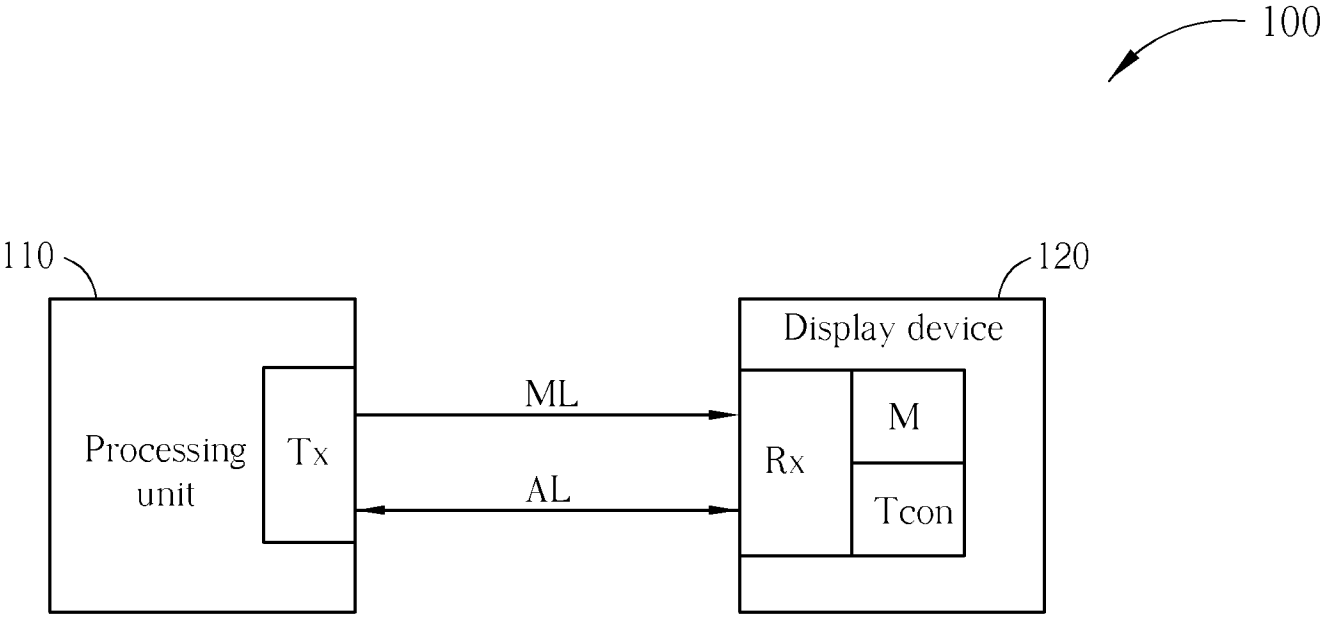
FIG. 1 PRIOR ART
FIG. 1 is a diagram illustrating a conventional portable device comprising DisplayPort interface.

Hereinafter, preferred embodiments of a method for synchronizing a display horizontal synchronization signal to an external horizontal synchronization signal and devices thereof of the present invention will be described in detail with reference to the accompanying drawings. Here, it is to be noted that the present invention is not limited thereto. Furthermore, step reference numerals are not meant to limit operating sequence, and any rearrangement of the operating sequence that achieves the same functionality is still within the spirit and scope of the present invention.

Figure 2:
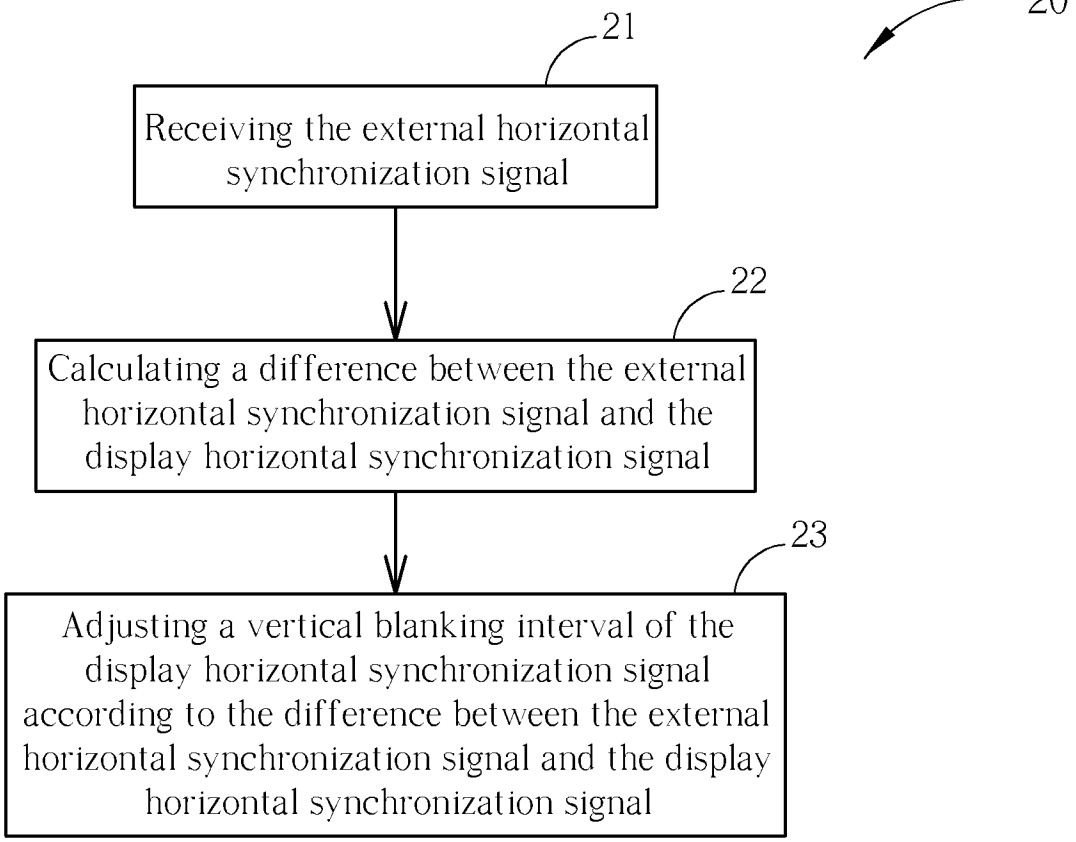
FIG. 2 is a flow chart illustrating a method of the present invention for synchronizing a display horizontal synchronization signal to an external horizontal synchronization signal.

Please refer to FIG. 2. FIG. 2 is a flow chart illustrating a method 20 of the present invention for synchronizing a display horizontal synchronization signal to an external horizontal synchronization signal. Steps of the method 20 include:

Step 21: receiving the external horizontal synchronization signal (H-SYNC);

Step 22: calculating a difference between the external horizontal synchronization signal and the display horizontal synchronization signal;

Step 23: adjusting a vertical blanking interval of the display horizontal synchronization signal according to the difference between the external horizontal synchronization signal and the display horizontal synchronization signal.

In step 23, the difference between the external horizontal synchronization signal and the display horizontal synchronization signal is compared with a threshold value, and then the vertical blanking interval of the display horizontal synchronization signal is adjusted according to the comparison result of the difference and the threshold value for synchronizing the display horizontal synchronization signal to the external horizontal synchronization signal. The method 20 of the present invention requires at most two frames to synchronize the display horizontal synchronization signal to the external horizontal synchronization signal.

Figure 3:
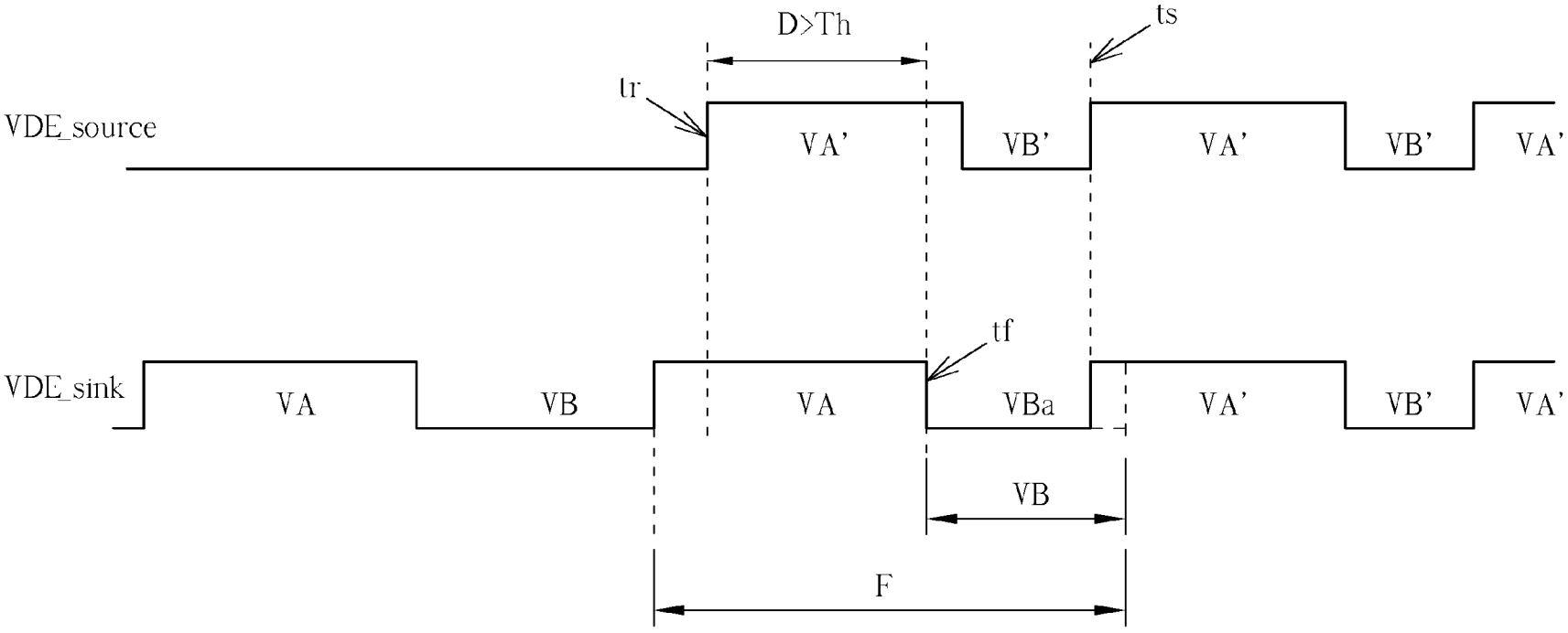
FIG. 3 is a diagram illustrating the method for synchronizing a display horizontal synchronization signal to an external horizontal synchronization signal according to a first embodiment of the present invention.

Please refer to FIG. 3. FIG. 3 is a diagram illustrating the method for synchronizing a display horizontal synchronization signal VDE_sink to an external horizontal synchronization signal VDE_source according to an embodiment of the present invention. Each pulse VA' of the external horizontal synchronization signal VDE_source and each pulse VA of the display horizontal synchronization signal VDE_sink represent the action of a display device sequentially driving a plurality of scan lines for displaying a frame. In other words, each pulse VA' and VA is equivalently comprised by a plurality of sub-pulses, and each sub-pulse corresponds to a scan signal of the display device for driving one scan line. A vertical blanking interval VB corresponds to a blanking interval of a vertical synchronization signal (V-SYNC) of the display device. The external horizontal synchronization signal VDE_source, such as a driving signal transmitted by the processing unit 110, can be similar to the display horizontal synchronization signal VDE_sink, but comprises different time sequence and frequency. For instance, a frequency of the external horizontal synchronization signal VDE_source is approximately 60 Hertz (Hz), and a frequency of the display horizontal synchronization signal VDE_sink is in a range of 40-60 Hz.

When the display device receives the external horizontal synchronization signal VDE_source, the timing controller adjusts the vertical blanking interval VB of the display horizontal synchronization signal VDE_sink according to the difference between the external horizontal synchronization signal VDE_source and the display horizontal synchronization signal VDE_sink. For instance, the difference between the external horizontal synchronization signal VDE_source and the display horizontal synchronization signal VDE_sink is obtained according to a time difference D between "a start time tr corresponding to when the external horizontal synchronization signal VDE_source starts driving a first scan line" and "an end time tf corresponding to when the display horizontal synchronization signal VDE_sink finishes driving a last scan line".

The end time tf of the display horizontal synchronization signal VDE_sink driving the last scan line corresponds to a start time of the vertical blanking interval VB of the display horizontal synchronization signal VDE_sink. Simply put, the time difference D is the difference between a rising edge of a pulse of the external horizontal synchronization signal VDE_source and a falling edge of the display horizontal synchronization signal VDE_sink in the same frame.

If the time difference D is larger than a threshold value Th (meaning phase of the external horizontal synchronization signal VDE_source is close to that of the display horizontal synchronization signal VDE_sink), the display device directly adjusts (e.g. increases or decreases) the vertical blanking interval VB of the display horizontal synchronization signal VDE_sink for the pulse VA of the display horizontal synchronization signal VDE_sink and the pulse VA' of the external horizontal synchronization signal VDE_source to be asserted (i.e. enabled) at the same time in the next frame. As shown in FIG. 3, the display device decreases the vertical blanking interval VB of the display horizontal synchronization signal VDE_sink to vertical blanking interval VBa for the pulse VA of the display horizontal synchronization signal VDE_sink and the pulse VA' of the external horizontal synchronization signal VDE_source to be asserted at the same time ts in the next frame.

When pulses VA and VA' are asserted at the same time ts, periods of the pulse VA and the vertical blanking interval VBa of the display horizontal synchronization signal VDE_sink are adjusted to be the same as periods of the pulse VA' and a vertical blanking interval VB' of the external horizontal synchronization signal VDE_source respectively. This way, the display horizontal synchronization signal VDE_sink is synchronized to the external horizontal synchronization signal VDE_source, and the timing controller of the display device can then drive the display device according to the external horizontal synchronization signal VDE_source. In the present embodiment, when the time difference D is larger than the threshold value Th, only one single frame is required for synchronizing the display horizontal synchronization signal VDE_sink to the external horizontal synchronization signal VDE_source.

During frame F of when the vertical blanking interval VBa is adjusted, a frame rate corresponding to the frame F is required to be equal to or larger than a predetermined frequency for preventing display flicker. For instance, the predetermined frequency is equal to or larger than 40 Hz, but is not limited to this.

Figure 4:
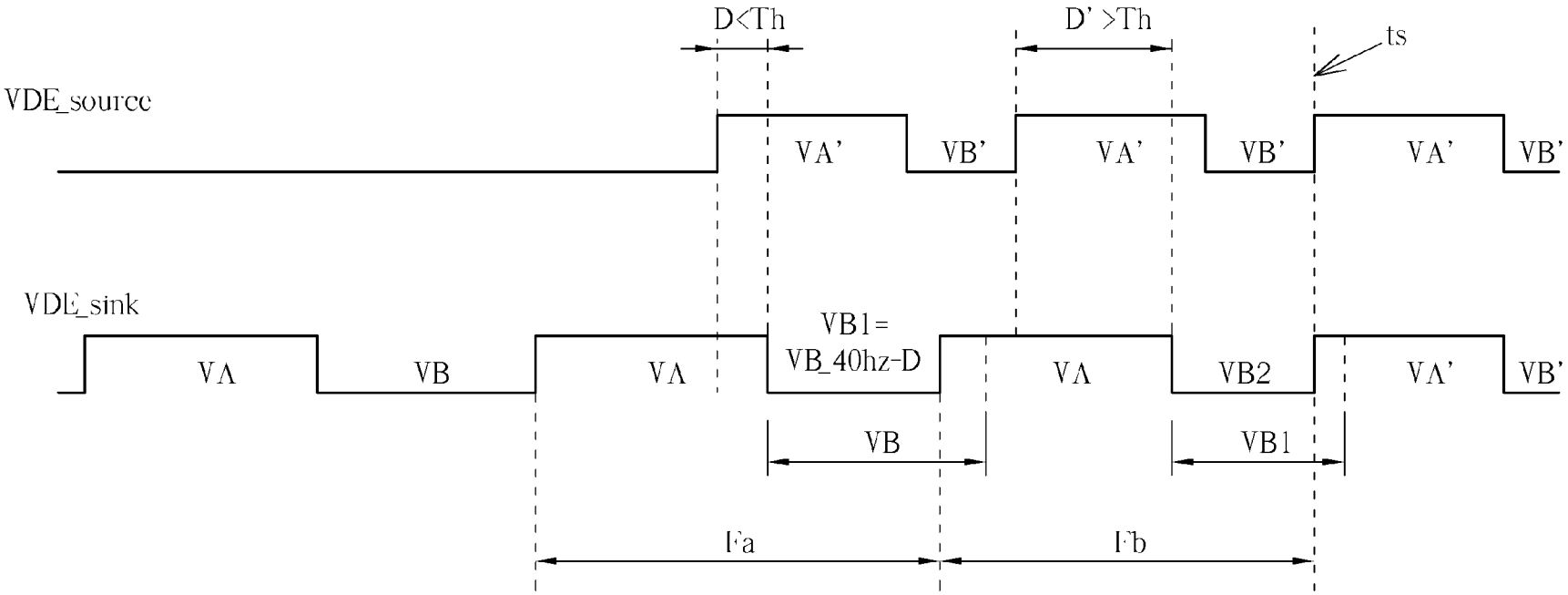
FIG. 4 is a diagram illustrating a method for synchronizing a display horizontal synchronization signal to an external horizontal synchronization signal according to a second embodiment of the present invention.

Please refer to FIG. 4. FIG. 4 is a diagram illustrating a method for synchronizing a display horizontal synchronization signal VDE_sink to an external horizontal synchronization signal VDE_source according to a second embodiment of the present invention. The display horizontal synchronization signal VDE_sink and the external horizontal synchronization signal VDE_source in FIG. 4 are similar to those shown in FIG. 3, except that the time difference D is smaller than the threshold value Th, meaning that phase of the external horizontal synchronization signal VDE_source is significantly different from that of the display horizontal synchronization signal VDE_sink.

When the time difference D is smaller than the threshold value Th, if the vertical blanking interval VB of the display horizontal synchronization signal VDE_sink is directly increased for the display horizontal synchronization signal VDE_sink to be asserted at the same time as the external horizontal synchronization signal VDE_source, the frame rate will be pulled too low, such that the user will perceive display flicker. Hence, when the time difference D is smaller than the threshold value Th, the vertical blanking interval VB of the display horizontal synchronization signal VDE_sink cannot be adjusted directly for the display horizontal synchronization signal VDE_sink to be synchronized to the external horizontal synchronization signal VDE_source in one single frame.

Therefore, when the external horizontal synchronization signal VDE_source is received in a first frame Fa and the time difference D is smaller than the threshold value Th, the display device adjusts a first vertical blanking interval VB1 of the display horizontal synchronization signal VDE_sink in the first frame Fa, for a time difference D' between the display horizontal synchronization signal VDE_sink and the external horizontal synchronization signal VDE_source to be larger than the threshold value Th in a second frame Fb. In the second frame Fb, a second vertical blanking interval VB2 of the display horizontal synchronization signal VDE_sink is then adjusted for the pulse VA of the display horizontal synchronization signal VDE_sink and the pulse VA' of the external horizontal synchronization signal VDE_source to be asserted at the same time ts in the next frame. When pulses VA and VA' are asserted at the same time ts, periods of the pulse VA and the second vertical blanking interval VB2 of the display horizontal synchronization signal VDE_sink are then adjusted to be the same as periods of the pulse VA' and the vertical blanking interval VB' respectively. This way, after receiving the external horizontal synchronization signal VDE_source, only two frames are required for synchronizing the display horizontal synchronization signal VDE_sink to the external horizontal synchronization signal VDE_source in the present embodiment.

As mentioned above, a frequency of the display horizontal synchronization signal VDE_sink can be in a range between 40-60 Hz. Regardless of which frequency between 40-60 Hz the display horizontal synchronization signal VDE_sink is, when the first vertical blanking interval VB1 is adjusted in the first frame Fa, the first vertical blanking interval VB1 is adjusted according to a difference between the time difference D and a vertical blanking interval corresponding to a minimum frame rate (e.g. 40 Hz) without causing display flicker. For instance, the first vertical blanking interval VB1 can be calculated according to formula (1):

$$VB1 = Vb_40\text{ hz} - D \quad (1)$$

Where Vb_40 hz is a constant representing the vertical blanking interval corresponding to a minimum frame rate (e.g. 40 Hz) required for not causing display flicker. For instance, when the frame rate is 40 Hz, the period of the display horizontal synchronization signal VDE_sink is 25 milliseconds (ms). Assuming the pulse VA is 14.36 ms, the corresponding vertical blanking interval, which is the constant Vb_40 hz, is then 10.64 ms (14.36 ms+10.64 ms=25 ms).

Figure 5:
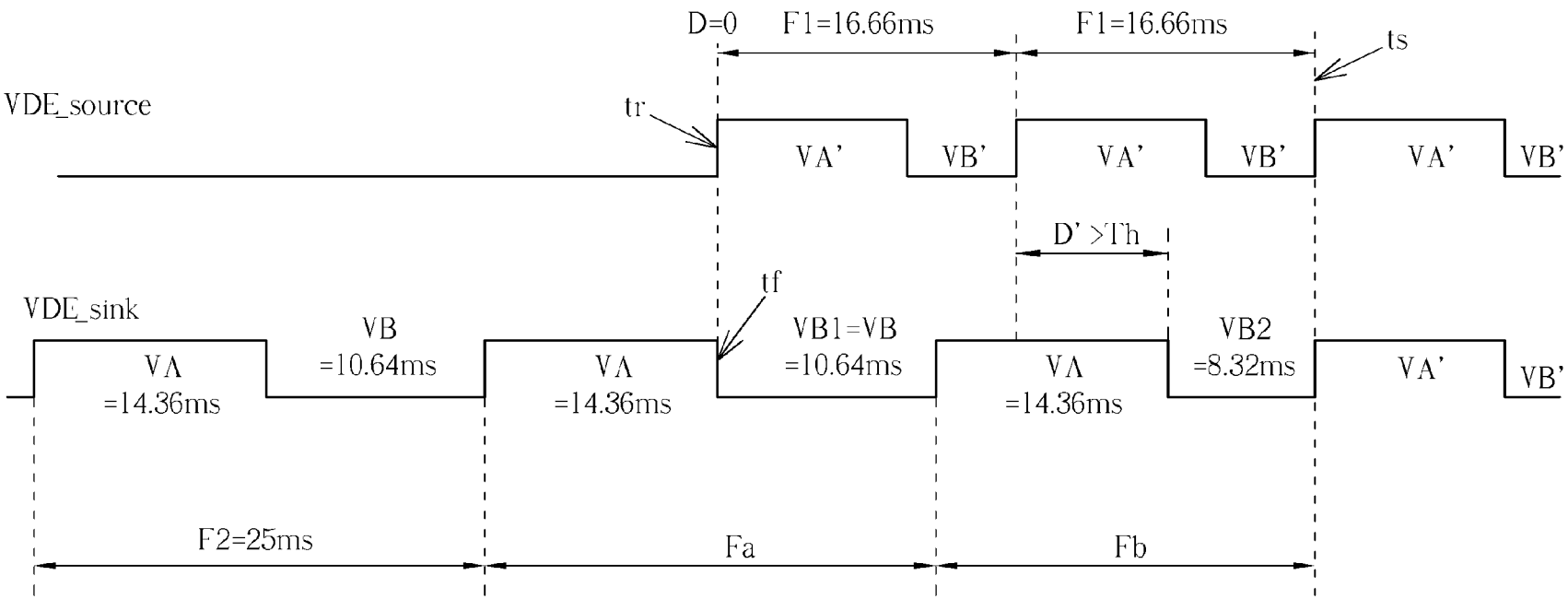
FIG. 5 is a diagram illustrating a method for synchronizing a display horizontal synchronization signal to an external horizontal synchronization signal according to a third embodiment of the present invention.

Please refer to FIG. 5. FIG. 5 is a diagram illustrating a method for synchronizing a display horizontal synchronization signal VDE_sink to an external horizontal synchronization signal VDE_source according to a third embodiment of the present invention. The embodiment shown in FIG. 5 is similar to FIG. 4 and the difference is that the time difference D is 0, meaning "the start time tr corresponding to when the external horizontal synchronization signal VDE_source starts driving the first scan line" overlaps "the end time tf corresponding to when the display horizontal synchronization signal VDE_sink finishes driving the last scan line".

Assuming frame rates of the external horizontal synchronization signal VDE_source and the display horizontal synchronization signal VDE_sink are 60 Hz and 40 Hz respectively, periods F1 and F2 of the external horizontal synchronization signal VDE_source and the display horizontal synchronization signal VDE_sink are then 16.66 ms and 25 ms respectively. Assuming a period of a pulse VA of the display horizontal synchronization signal VDE_sink is 14.36 ms, periods of the vertical blanking interval VB and the constant Vb_40 hz are then both 10.64 ms (i.e. 25 ms−14.36 ms=10.64 ms). Since the time difference D is 0, which is smaller than the threshold value Th, phase difference between the external horizontal synchronization signal VDE_source and the display horizontal synchronization signal VDE_sink are large enough so the synchronization between the external horizontal synchronization signal VDE_source and the display horizontal synchronization signal VDE_sink cannot be completed in one frame without flicker.

According to formula (1), the first vertical blanking interval VB1 of the display horizontal synchronization signal VDE_sink in the first frame Fa is 10.64 ms (i.e. 10.64 ms−0=10.64 ms). On the other hand, a time difference D' in the second frame Fb is larger than the threshold value Th. In other words, a second vertical blanking interval VB2 in the second frame Fb can be adjusted directly for the pulse VA of the display horizontal synchronization signal VDE_sink and the pulse VA' of the external horizontal synchronization signal VDE_source to be asserted (i.e. enabled) at the same time ts, without causing flicker due to pulling the corresponding frame rate too low.

After receiving the external horizontal synchronization signal VDE_source, the synchronization must be done within two frames, which is equivalent to 2*16.66 ms=33.32 ms. The periods of the pulse VA and the first vertical blanking interval VB1 are known, hence the second vertical blanking interval VB2 in the second frame Fb is adjusted accordingly to 8.32 ms (i.e. 33.32 ms−[14.36 ms+10.64 ms]=8.32 ms). This way, the pulse VA of the display horizontal synchronization signal VDE_sink and the pulse VA' of the external horizontal synchronization signal VDE_source can then be asserted (i.e. enabled) at the same time ts. When pulses VA and VA' are asserted at the same time ts, periods of the pulse VA and the second vertical blanking interval VB2 of the display horizontal synchronization signal VDE_sink are then adjusted to be equal to periods of the pulse VA' and the vertical blanking interval VB' of the external horizontal synchronization signal VDE_source respectively.

This way, the external horizontal synchronization signal VDE_source and the display horizontal synchronization signal VDE_sink can be synchronized in two frames. By adjusting the second vertical blanking interval VB2 from 10.64 ms to 8.32 ms in the present embodiment, the period of the second frame Fb changes to 44 Hz (i.e. $[14.36\ ms+8.32\ ms]^{-1}=44\ Hz$), which does not cause flicker.

In the embodiments shown in FIG. 4 and FIG. 5, when the time difference D is smaller than the threshold value Th, only two frames are required for synchronizing the display horizontal synchronization signal VDE_sink to the external horizontal synchronization signal VDE_source. More specifically, when the time difference D is smaller than the threshold value Th, the first vertical blanking interval VB1 is reduced, and then the second vertical blanking interval VB2 is reduced, for the pulse VA of the display horizontal synchronization signal VDE_sink and the pulse VA' of the external horizontal synchronization signal VDE_source to be asserted at the same time.

However, when the display horizontal synchronization signal VDE_sink corresponds to a minimum frame rate (e.g. 40 Hz) for not causing display flicker and the time difference D is 0, the first vertical blanking interval VB1 remains unchanged, but the second vertical blanking interval VB2 is reduced for the pulse VA of the display horizontal synchronization signal VDE_sink and the pulse VA' of the external horizontal synchronization signal VDE_source to be asserted at the same time.

FIG. 3 illustrates an embodiment of utilizing one frame for synchronization when the time difference D is larger than the threshold value Th. FIG. 4 and FIG. 5 illustrate embodiments of utilizing two frames for synchronization when the time difference D is smaller than the threshold value Th. When the time difference D equals the threshold value Th, the display horizontal synchronization signal VDE_sink can be synchronized to the external horizontal synchronization signal VDE_source according to the method shown in FIG. 3, or methods shown in FIG. 4 and FIG. 5.

In another embodiment, for instance, when the time difference D is larger than the threshold value Th, the vertical blanking interval VB of the display horizontal synchronization signal VDE_sink can be directly adjusted, as shown in FIG. 3, for synchronizing the display horizontal synchronization signal VDE_sink to the external horizontal synchronization signal VDE_source. When the time difference D is not larger than (i.e. equal to or smaller than) the threshold value Th, the first vertical blanking interval VB1 of the display horizontal synchronization signal VDE_sink is adjusted first for the time difference D' to be larger than the threshold value Th, and then the second vertical blanking interval VB2 of the display horizontal synchronization signal VDE_sink is adjusted according to FIG. 4 or FIG. 5, for synchronizing the display horizontal synchronization signal VDE_sink to the external horizontal synchronization signal VDE_source.

On the other hand, in another embodiment, if the time difference D is not smaller than (i.e. larger than or equal to) the threshold value Th, the vertical blanking interval VB of the display horizontal synchronization signal VDE_sink can be directly adjusted according to FIG. 3, for synchronizing the display horizontal synchronization signal VDE_sink to the external horizontal synchronization signal VDE_source. If the time difference D is smaller than the threshold value Th, the first vertical blanking interval VB1 and the second vertical blanking interval VB2 are sequentially adjusted according to FIG. 4 or FIG. 5, for synchronizing the display horizontal synchronization signal VDE_sink to the external horizontal synchronization signal VDE_source.

Figure 6:
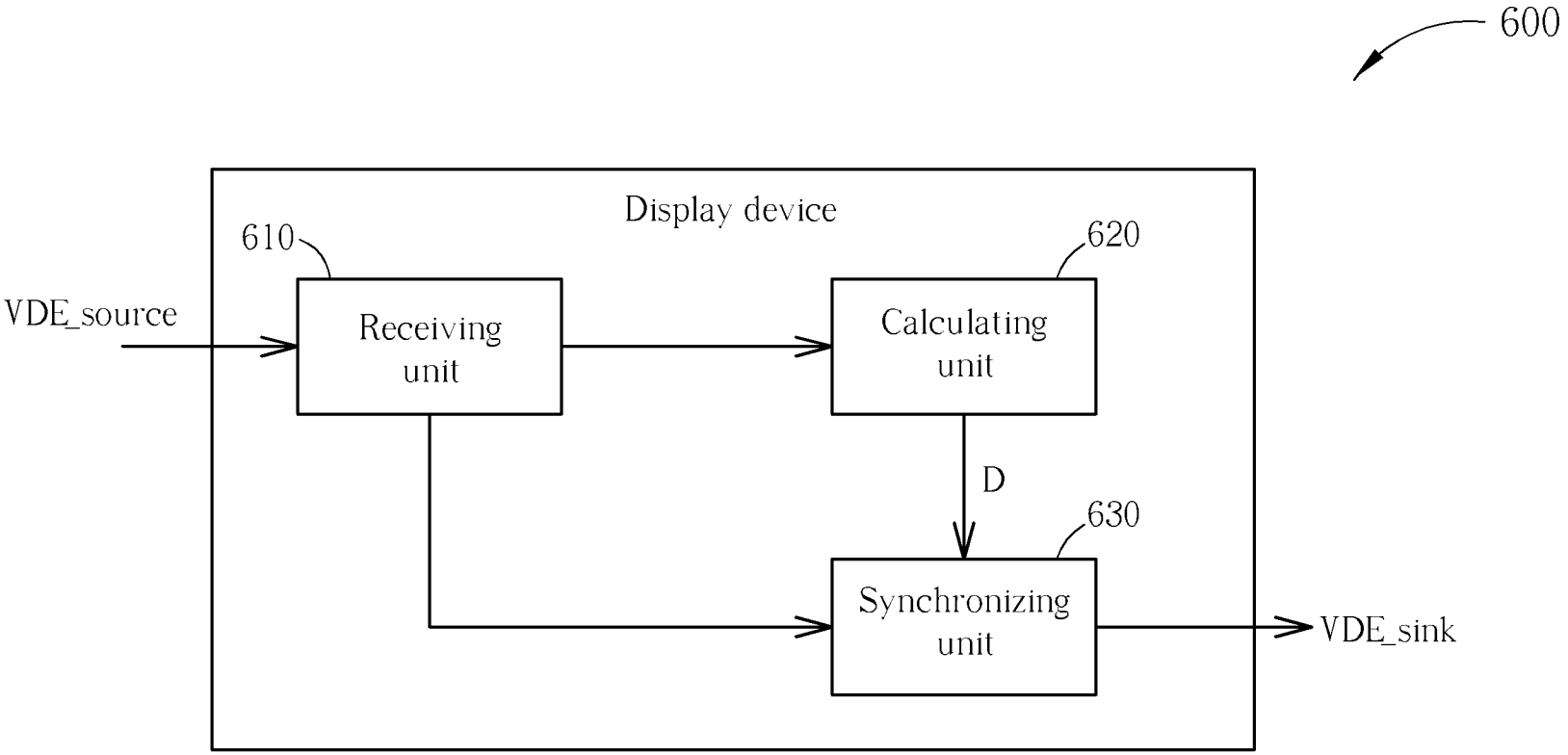
FIG. 6 is a diagram illustrating a display device according to an embodiment of the present invention.

Please refer to FIG. 6. FIG. 6 is a diagram illustrating a display device 600 according to an embodiment of the present invention. The display device 600 comprises a receiving unit 610, a calculating unit 620 and a synchronizing unit 630. The receiving unit 610 is for receiving an external horizontal synchronization signal VDE_source. The calculating unit 620, for example, an arithmetic logic unit (ALU) or a microprocessor, is coupled to the receiving unit 610, for calculating a difference (e.g. time difference D) between the external horizontal synchronization signal VDE_source and a display horizontal synchronization signal VDE_sink. The synchronizing unit 630 is coupled to the receiving unit 610 and the calculating unit 620 for outputting the display horizontal synchronization signal VDE_sink. The synchronizing unit 630 adjusts a vertical blanking interval of the display horizontal synchronization signal VDE_sink according to the difference between the external horizontal synchronization signal VDE_source and the display horizontal synchronization signal VDE_sink for synchronizing the display horizontal synchronization signal VDE_sink to the external horizontal synchronization signal VDE_source. When the display horizontal synchronization signal VDE_sink is in sync with the external horizontal synchronization signal VDE_source, the synchronizing unit 630 can directly receive the external horizontal synchronization signal VDE_source from the receiving unit 610 for driving the display device 600. The receiving unit 610, the calculating unit 620 and the synchronizing unit 630 can be disposed in, for instance, a timing controller of the display device 600, but are not limited to this.

Figure 7:
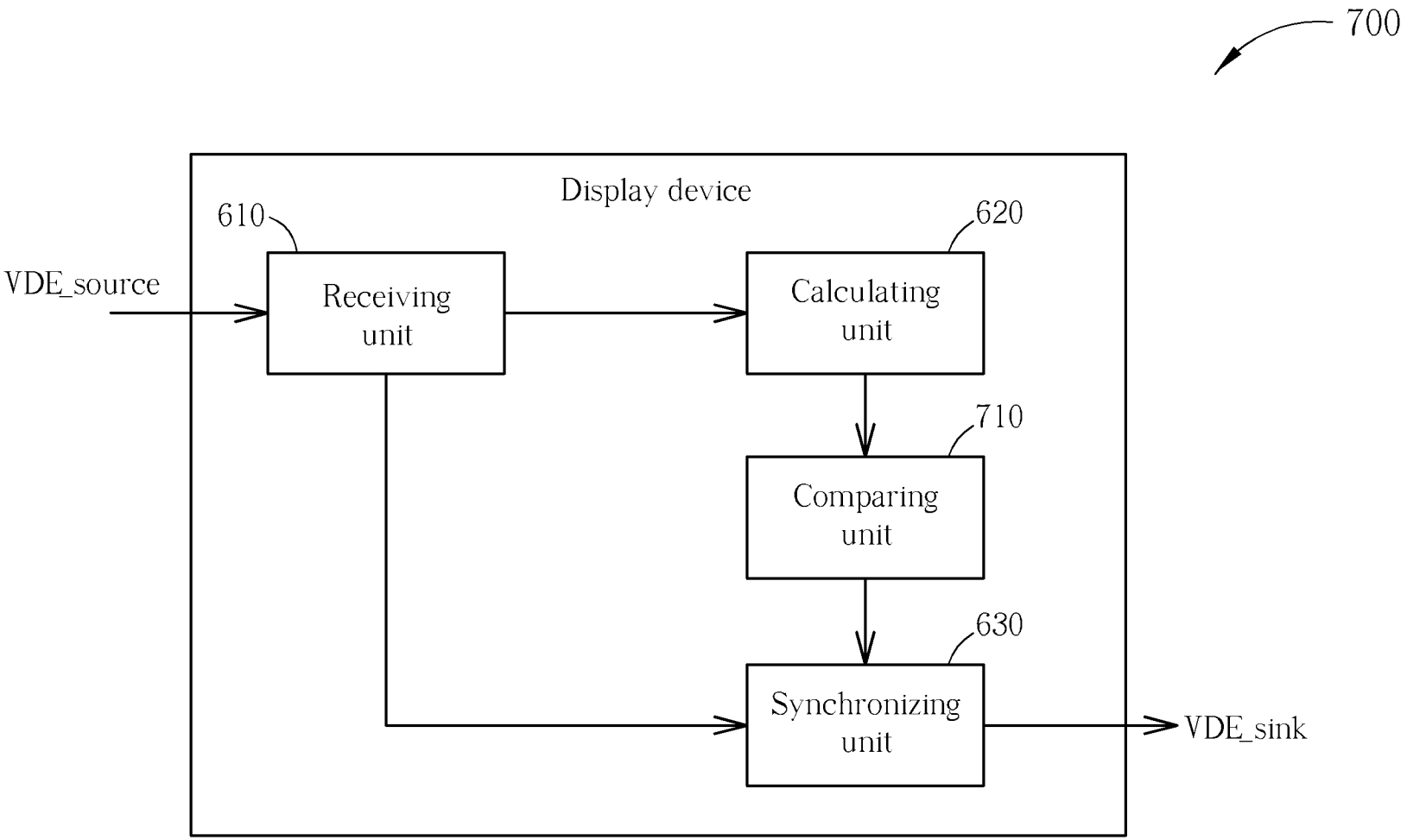
FIG. 7 is a diagram illustrating a display device according to another embodiment of the present invention.

Please refer to FIG. 7. FIG. 7 is a diagram illustrating a display device 700 according to another embodiment of the present invention. The display device 700 is similar to the display device 600 in FIG. 6, and a difference is that the display device 700 further comprises a comparing unit 710, coupled between the calculating unit 620 and the synchronizing unit 630, for comparing "a difference between the external horizontal synchronization signal VDE_source and the display horizontal synchronization signal VDE_sink" to "a threshold value". The synchronizing unit 630 receives a comparison result between the said difference and the threshold value from the comparing unit 710. The synchronizing unit 630 then adjusts the vertical blanking interval of the display horizontal synchronization signal VDE_sink according to the comparison result, for synchronizing the display horizontal synchronization signal VDE_sink to the external horizontal synchronization signal VDE_source.

The above mentioned methods and related devices are merely exemplifying embodiments of the present invention. Those skilled in the art can certainly make appropriate modifications according to practical demands.

In conclusion, the method of the present invention adjusts a vertical blanking interval of a display horizontal synchronization signal according to a difference between an external horizontal synchronization signal and the display horizontal synchronization signal. The method of the present invention requires at least one frame, or at most two frames, for synchronizing the display horizontal synchronization signal to the external horizontal synchronization signal. Since the method of the present invention maintains frame rate of a display device above a minimum frame rate (e.g. 40 Hz) required for not causing display flicker, the synchronization process will not cause the user to perceive display flicker. Further, since the method of the present invention requires at most two frames to synchronize the display horizontal synchronization signal to the external horizontal synchronization signal, very little time is required to achieve synchronization, so the user will not perceive display pauses during the synchronization process. The method of the present invention can utilize existing hardware to adjust the vertical blanking interval of the display horizontal synchronization signal, without requiring complicated read/write actions of a frame buffer or extra hardware resources such as line buffer, etc.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for synchronizing a display horizontal synchronization signal to an external horizontal synchronization signal, comprising:

receiving the external horizontal synchronization signal, wherein an original pulse width of the external horizontal synchronization signal is different from an original pulse width of the display horizontal synchronization signal, and an original time length of a vertical blanking interval of the external horizontal synchronization signal is different from an original time length of a vertical blanking interval of the display horizontal synchronization signal;

calculating a difference between the external horizontal synchronization signal and the display horizontal synchronization signal, wherein the difference is a time difference between a rising edge of the external horizontal synchronization signal and a falling edge of the display horizontal synchronization signal in a same frame; and adjusting the vertical blanking interval of the display horizontal synchronization signal according to the difference between the external horizontal synchronization signal and the display horizontal synchronization signal, for synchronizing the display horizontal synchronization signal to the external horizontal synchronization signal.

2. The method of claim 1, wherein adjusting the vertical blanking interval of the display horizontal synchronization signal according to the difference between the external horizontal synchronization signal and the display horizontal synchronization signal is: when the time difference is larger than a threshold value, adjusting the vertical blanking interval of the display horizontal synchronization signal, for synchronizing the display horizontal synchronization signal to the external horizontal synchronization signal.

3. The method of claim 1, wherein adjusting the vertical blanking interval of the display horizontal synchronization signal according to the difference between and the display horizontal synchronization signal is: when the time difference is not larger than a threshold value, adjusting a first vertical blanking interval of the display horizontal synchronization signal first, then adjusting a second vertical blanking interval of the display horizontal synchronization signal, for synchronizing the display horizontal synchronization signal to the external horizontal synchronization signal.

4. The method of claim 3, wherein adjusting the first vertical blanking interval of the display horizontal synchronization signal is: adjusting the first vertical blanking interval of the display horizontal synchronization signal according to a difference between the time difference and a vertical blanking interval corresponding to a minimum frame rate which does not cause display flicker.

5. The method of claim 1, wherein adjusting the vertical blanking interval of the display horizontal synchronization signal according to the difference between the external horizontal synchronization signal and the display horizontal synchronization signal is: when the time difference is not smaller than a threshold value, adjusting the vertical blanking interval of the display horizontal synchronization signal for synchronizing the display horizontal synchronization signal to the external horizontal synchronization signal.

6. The method of claim 1, wherein adjusting the vertical blanking interval of the display horizontal synchronization signal according to the difference between the external horizontal synchronization signal and the display horizontal synchronization signal is: when the time difference is smaller than a threshold value, adjusting a first vertical blanking interval of the display horizontal synchronization signal first, for the time difference to be not less than the threshold value, and then adjusting a second vertical blanking interval of the display horizontal synchronization signal, for synchronizing the display horizontal synchronization signal to the external horizontal synchronization signal.

7. The method of claim 6, wherein adjusting the first vertical blanking interval of the display horizontal synchronization signal is: adjusting the first vertical blanking interval of the display horizontal synchronization signal according to a difference between the time difference and a vertical blanking interval corresponding to a minimum frame rate which does not cause display flicker.

8. The method of claim 1, further comprising comparing the difference to a threshold value, wherein adjusting the vertical blanking interval of the display horizontal synchronization signal according to the difference between the external horizontal synchronization signal and the display horizontal synchronization signal, for synchronizing the display horizontal synchronization signal to the external horizontal synchronization signal is: adjusting the vertical blanking interval of the display horizontal synchronization signal according to the a comparison result between the difference and the threshold value for synchronizing the display horizontal synchronization signal to the external horizontal synchronization signal.

9. A display device, comprising:

a receiving unit for receiving an external horizontal synchronization signal, wherein an original pulse width of the external horizontal synchronization signal is different from an original pulse width of a display horizontal synchronization signal, and an original time length of a vertical blanking interval of the external horizontal synchronization signal is different from an original time length of a vertical blanking interval of the display horizontal synchronization signal;

a calculating unit for calculating a difference between the external horizontal synchronization signal and a display horizontal synchronization signal, wherein the difference is a time difference between a rising edge of the external horizontal synchronization signal and a falling edge of the display horizontal synchronization signal in a same frame"; and a synchronizing unit for adjusting the vertical blanking interval of the display horizontal synchronization signal according to the difference between the external horizontal synchronization signal and the display horizontal synchronization signal for synchronizing the display horizontal synchronization signal to the external horizontal synchronization signal.

10. The display device of claim 9, further comprising a comparing unit for comparing the difference to a threshold value, wherein the synchronizing unit adjusts the vertical blanking interval of the display horizontal synchronization signal according to a comparison result between the difference and the threshold value for synchronizing the display horizontal synchronization signal to the external horizontal synchronization signal.

11. A method for synchronizing a display horizontal synchronization signal to an external horizontal synchronization signal, comprising:

receiving the external horizontal synchronization signal, wherein a phase difference exists between the external horizontal synchronization signal and the display horizontal synchronization signal, an original pulse width of the external horizontal synchronization signal is different from an original pulse width of the display horizontal synchronization signal, and an original time length of a vertical blanking interval of the external horizontal synchronization signal is different from an original time length of a vertical blanking interval of the display horizontal synchronization signal; and adjusting the vertical blanking interval of the display horizontal synchronization signal according to a difference between the external horizontal synchronization signal and the display horizontal synchronization signal, for synchronizing the display horizontal synchronization signal to the external horizontal synchronization signal;

wherein the difference is a time difference between a rising edge of the external horizontal synchronization signal and a falling edge of the display horizontal synchronization signal in a same frame".

12. The method of claim 11, wherein adjusting the vertical blanking interval of the display horizontal synchronization signal according to the difference between the external horizontal synchronization signal and the display horizontal synchronization signal is: when the time difference is larger than a threshold value, adjusting the vertical blanking interval of the display horizontal synchronization signal, for synchronizing the display horizontal synchronization signal to the external horizontal synchronization signal.

13. The method of claim 11, wherein adjusting the vertical blanking interval of the display horizontal synchronization signal according to the difference between the external horizontal synchronization signal and the display horizontal synchronization signal is: when the time difference is not larger than a threshold value, adjusting a first vertical blanking interval of the display horizontal synchronization signal first, then adjusting a second vertical blanking interval of the display horizontal synchronization signal, for synchronizing the display horizontal synchronization signal to the external horizontal synchronization signal.

14. The method of claim 13, wherein adjusting the first vertical blanking interval of the display horizontal synchronization signal is: adjusting the first vertical blanking interval of the display horizontal synchronization signal according to a difference between the time difference and a vertical blanking interval corresponding to a minimum frame rate which does not cause display flicker.

15. The method of claim 11, wherein adjusting the vertical blanking interval of the display horizontal synchronization signal according to the difference between the external horizontal synchronization signal and the display horizontal synchronization signal is: when the time difference is not smaller than a threshold value, adjusting the vertical blanking interval of the display horizontal synchronization signal for synchronizing the display horizontal synchronization signal to the external horizontal synchronization signal.

16. The method of claim 11, wherein adjusting the vertical blanking interval of the display horizontal synchronization signal according to the difference between the external horizontal synchronization signal and the display horizontal synchronization signal is: when the time difference is smaller than a threshold value, adjusting a first vertical blanking interval of the display horizontal synchronization signal first, for the time difference to be not less than the threshold value, and then adjusting a second vertical blanking interval of the display horizontal synchronization signal, for synchronizing the display horizontal synchronization signal to the external horizontal synchronization signal.

17. The method of claim 16, wherein adjusting the first vertical blanking interval of the display horizontal synchronization signal is: adjusting the first vertical blanking interval of the display horizontal synchronization signal according to a difference between the time difference and a vertical blanking interval corresponding to a minimum frame rate which does not cause display flicker.

18. The method of claim 11, further comprising comparing the difference to a threshold value, wherein adjusting the vertical blanking interval of the display horizontal synchronization signal according to the difference between the external horizontal synchronization signal and the display horizontal synchronization signal, for synchronizing the display horizontal synchronization signal to the external horizontal synchronization signal is: adjusting the vertical blanking interval of the display horizontal synchronization signal according to the a comparison result between the difference and the threshold value for synchronizing the display horizontal synchronization signal to the external horizontal synchronization signal.

* * * * *